US006568662B2

(12) United States Patent
Schuld

(10) Patent No.: US 6,568,662 B2
(45) Date of Patent: May 27, 2003

(54) ADAPTABLE EVAPORATIVE ELEMENT FOR A HUMIDIFIER

(75) Inventor: Daniel E. Schuld, Hampshire, IL (US)

(73) Assignee: RPS Products, Inc., Hampshire, IL (US)

( * ) Notice: Subject to any disclaimer, the term of this patent is extended or adjusted under 35 U.S.C. 154(b) by 1 day.

(21) Appl. No.: 09/781,870

(22) Filed: Feb. 12, 2001

(65) Prior Publication Data

US 2002/0109245 A1 Aug. 15, 2002

(51) Int. Cl.[7] ..... B01F 3/04

(52) U.S. Cl. ..... 261/94; 261/100; 261/106; 261/107; 428/136

(58) Field of Search ..... 261/94, 99, 100, 261/106, 107, 103, 104; 55/529, DIG. 5, DIG. 31; 428/135, 136

(56) References Cited

U.S. PATENT DOCUMENTS

| | | | | | |
|---|---|---|---|---|---|
| 2,175,903 | A | * | 10/1939 | Lichtman | 55/DIG. 31 |
| 2,637,540 | A | | 5/1953 | Rowe | 261/94 |
| 2,955,064 | A | | 10/1960 | Frohmader | 154/46 |
| 3,092,442 | A | | 6/1963 | Shoemaker | 21/53 |
| 3,155,560 | A | | 11/1964 | Onstad et al. | 156/222 |
| 3,242,562 | A | * | 3/1966 | Kraft | 55/DIG. 5 |
| D243,335 | S | | 2/1977 | Trombley | D23/146 |
| D243,336 | S | | 2/1977 | Painter | D23/146 |
| 4,014,796 | A | * | 3/1977 | Sugiyama et al. | 55/DIG. 31 |
| 4,042,358 | A | | 8/1977 | Frohmader | 55/497 |
| 4,117,045 | A | | 9/1978 | Henke et al. | 261/30 |
| 4,151,095 | A | * | 4/1979 | Wright | 55/DIG. 5 |
| 4,251,583 | A | * | 2/1981 | Donachiue | 261/107 |
| 4,338,266 | A | | 7/1982 | Flower | 261/94 |
| 4,504,290 | A | | 3/1985 | Pontius | 55/316 |
| 4,701,196 | A | | 10/1987 | Delany | 55/481 |
| 4,746,432 | A | * | 5/1988 | Taki et al. | 55/529 |
| 4,839,086 | A | | 6/1989 | Zaid | 252/182.3 |
| 5,037,583 | A | | 8/1991 | Hand | 261/26 |
| 5,087,276 | A | * | 2/1992 | Snyder | 55/DIG. 31 |
| 5,110,511 | A | | 5/1992 | Hand | 261/104 |
| 5,133,904 | A | | 7/1992 | Pepper | 261/24 |
| 5,145,500 | A | * | 9/1992 | Nolen, Jr. | 55/DIG. 31 |
| 5,188,646 | A | * | 2/1993 | Nolen, Jr. | 55/DIG. 31 |
| D337,634 | S | | 7/1993 | Copland et al. | D23/356 |
| 5,250,232 | A | | 10/1993 | Pepper et al. | 261/24 |
| 5,374,381 | A | | 12/1994 | Schuld et al. | 261/106 |
| 5,476,526 | A | * | 12/1995 | Attermeyer | 55/DIG. 31 |
| D374,480 | S | | 10/1996 | Micoley | D23/356 |
| D376,419 | S | | 12/1996 | Seaman et al. | D23/356 |
| 5,681,630 | A | * | 10/1997 | Smick et al. | 55/529 |
| 5,807,415 | A | * | 9/1998 | Leo | 55/529 |
| 6,007,596 | A | * | 12/1999 | Rosen | 55/DIG. 31 |

FOREIGN PATENT DOCUMENTS

| | | | |
|---|---|---|---|
| CA | 2044023 | | 4/1992 |
| JP | 4-367703 | * | 12/1992 |
| JP | 5-103931 | * | 4/1993 |
| JP | 6-226024 | * | 8/1994 |

OTHER PUBLICATIONS

Coolpad Article.

* cited by examiner

*Primary Examiner*—C. Scott Bushey
(74) *Attorney, Agent, or Firm*—Greer, Burns & Crain, LTD

(57) ABSTRACT

An adaptable evaporative element for a humidifier or the like is described. It includes an evaporative element having at least one fold, such that the size of the evaporative element is adaptable by varying said evaporative element between a folded and an unfolded configuration.

12 Claims, 5 Drawing Sheets

ADAPTABLE EVAPORATIVE ELEMENT FOR A HUMIDIFIER

BACKGROUND

The present invention relates to evaporative elements and filters for use in humidifiers, evaporative coolers and the like. The invention specifically relates to evaporative elements that are adaptable to fit multiple sizes of humidifiers.

For many years, humidifiers have been manufactured and sold having replaceable evaporative elements, also known as filter cartridges. The purpose of the evaporative element, through which air may freely pass, is to spread water over a large surface area to promote evaporation of the water into the air when air is directed over and through the element. The evaporative element may also perform a subsidiary function of filtering the air and/or water. It is well recognized in the art that it is desirable to have an element, that has a large surface area. It is also well known to make the evaporative element from materials that promote capillary or wicking action to absorb and spread the water throughout the evaporative element. Coatings are known that aid water retention and distribution on non-porous surfaces. The evaporative element should be made of materials and with a configuration sufficient to maintain structural integrity of the evaporative element when it is subjected to prolonged use in water, heat and air flow circulation.

A large variety of humidifiers are marketed and sold, both commercially and to consumers, in a variety of shapes and sizes. Further, even after a particular model of humidifier is discontinued or modified, there is a market for replacement cartridges for that humidifier with owners of such units, who become frustrated if they are unable to find replacement cartridges when their humidifier is still in working condition. These factors combine to produce a large number of evaporative elements available for purchase, which retailers, such as hardware or home improvement stores, attempt to carry for the convenience of their customers. Retailers not only dedicate shelf space to this plethora of cartridges, but also generate a large number of SKUs, and the associated problems in inventory control, warehousing, shipping and distribution of the cartridges.

Further, the availability of so many different evaporative elements may be confusing to the consumer. Particular manufacturers often use cartridges of the same general shape, varying the dimensions only slightly. Recognizing the manufacturer's name, the consumer may purchase a cartridge that is similar to that needed for his humidifier, but later find that it does not fit properly.

Other consumers may purchase a cartridge that is too large for their unit, then attempt to cut it to size using the old cartridge as a template. However, after normal aging and prolonged use in water, the evaporative elements may have swelled, begun to sag, or lost their original shape for other reasons. When the old cartridge is used as a template, the new one may not be cut to the correct size, and may not fit properly. Humidification efficiency may be lost if air is permitted to bypass the evaporative element without being exposed to the water thereon.

The need to reduce the number of evaporative elements available for humidifying appliances has resulted in universal cartridges that are adaptable to fit more than one humidifier. One such prior art device consists of a large cartridge made of materials that are cut to size by the consumer. Included with the cartridge is a sheet of paper with numerous lines indicating where the evaporative media is to be cut, to create a cartridge the correct size for the consumer's humidifier. The consumer then must hold the paper in place without it moving while cutting the evaporative elements. If the paper shifts during cutting, the cartridge may be ruined or may result in an imprecise fit in the humidifier by allowing air to bypass the evaporative element altogether. In the alternative, the consumer may choose to use a time-consuming, multi-step process of cutting the paper, marking the evaporative element, then cutting it.

Thus there is a need in the art for evaporative elements for humidifiers that fit more than one model so as to reduce the number of replacement parts that retailers must distribute, and yet provide a convenient means to the consumer of adapting the evaporative element.

SUMMARY OF THE INVENTION

These and other objects are met or exceeded by the present invention which features an evaporative element that fits humidifiers of more than one size. Use of such an evaporative element allows retailers to stock fewer different cartridges, and makes it less likely that the consumer will purchase an evaporative element that will not fit his humidifier.

More specifically, the invention relates to an adaptable evaporative element for a humidifier or the like. A first embodiment is a cylindrical evaporative element with a folded portion, such that the size of the evaporative element is adaptable by varying the evaporative element between a folded and an unfolded configuration. Preferably, it includes a plurality of prefolded, stacked layers of a water retaining media and at least one layer of a prefolded, perforated, substantially rigid, malleable material. The rigid layer is juxtaposed to at least one of the layers of water retaining media for supporting the layers, and for holding the stacked layers in either a prefolded or an unfolded configuration. An adhesive means is used for bonding the layers of media together and for bonding the rigid material layer to the water retaining media layers to form a laminated evaporative element. The size of the evaporative element is conveniently adapted by opening the fold to fit a humidifier requiring a larger evaporative media.

In an alternate embodiment, the evaporative element has a slit extending sufficiently through the thickness of the evaporative element that the evaporative element is separable into two portions along the slit without the use of tools, such that the size of the evaporative element is adaptable by varying the evaporative element between a separated and an unseparated configuration. Preferably, the evaporative element includes a plurality of stacked, perforated, layers of substantially rigid material with a water retaining coating on the exterior of said substantially rigid material. An adhesive means bonds the layers together, forming a laminated evaporative element. A slit extends sufficiently through the thickness of the evaporative element that it is separable into two portions along the slit without the use of tools. The size of said evaporative element is adaptable by breaking off the separable portion to create an evaporative element of a size smaller than when purchased.

A third embodiment of the invention includes a guide attached to the evaporative element for cutting it to one of a plurality of cut configurations; such that the size of the evaporative element is adaptable by varying the evaporative element between an uncut and one of a plurality of cut configurations. Preferably, the evaporative element includes a plurality of stacked layers of cuttable, water retaining media. An adhesive means bonds the layers together, forming a laminated evaporative element. As purchased, a guide is attached to the evaporative element for cutting it to one of a plurality of cut configurations. Adhesion of the guide to the evaporative element allows cutting of the evaporative element in a single step, yet preventing the guide from slipping during the cutting process. The size of the evaporative element is thus adaptable by cutting the cutting guide and the evaporative element together to obtain one of the plurality of cut configurations.

Each of these embodiments yields an evaporative element for a humidifier that is most suitable as a replacement part. The resulting cartridges assist retailers in reducing the number of replacement cartridges that they must carry in stock in order to satisfy the needs of the consumers. This reduction also saves warehouse and shelf space, and limits the number of items and SKUs that must be tracked on inventories.

The cartridges of this invention are also convenient for the consumer. Use of the evaporative cartridges of the present invention permit adaptation of a cartridge to multiple sizes with little chance of error by cutting of a cartridge to the wrong size. The number of steps required to generate the appropriate size evaporative element is reduced, in some cases to a single step.

Accordingly, the objects of the invention have been well satisfied. These advantages and others will become more fully apparent from the following detailed description when read in conjunction with the accompanying drawings.

DETAILED DESCRIPTION OF THE DRAWINGS

DETAILED DESCRIPTION OF THE INVENTION

Figure 1:
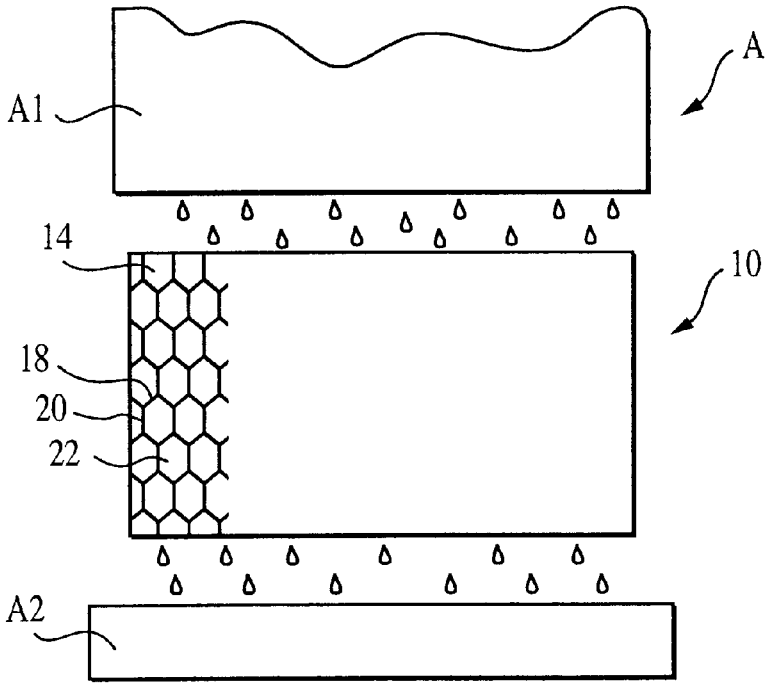
FIG. 1 is a schematic representation of a trickle down type humidifier.

Referring now to FIG. 1, the invention comprises an adaptable evaporative element, generally 10, for a humidifier, generally A, or the like. The humidifier A is shown diagrammatically as comprising a water source A1 and a water collection pan A2. Water is directed from source A1 through the evaporative element 10 and is collected for recirculation in pan A2. Air is preferably directed by a fan, blower or other means (not shown) through element 10 in a general direction normal to the surface of the drawing. The trickle down type of humidifier A is merely shown as one example of a use for the evaporative element 10 of the invention.

Alternatively, the evaporative element 10 of the invention may be used in other types of humidifiers A, including, but not limited to wick-up types where the element is partially immersed in a water bath, or rotary types where the evaporative element is partially immersed in a bath and rotated. Additionally, the element of the invention may be used in evaporative coolers.

Figure 3:
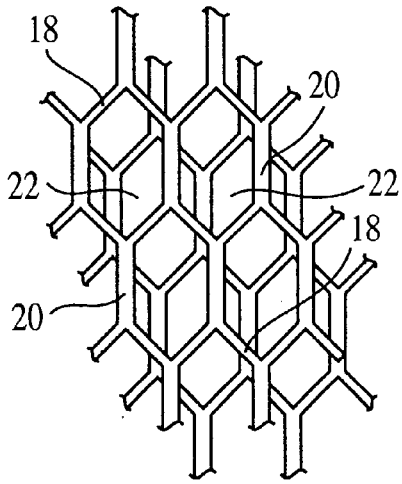
FIG. 3 is a detailed plan view of a portion of the evaporative element of FIG. 2.
Figure 2:
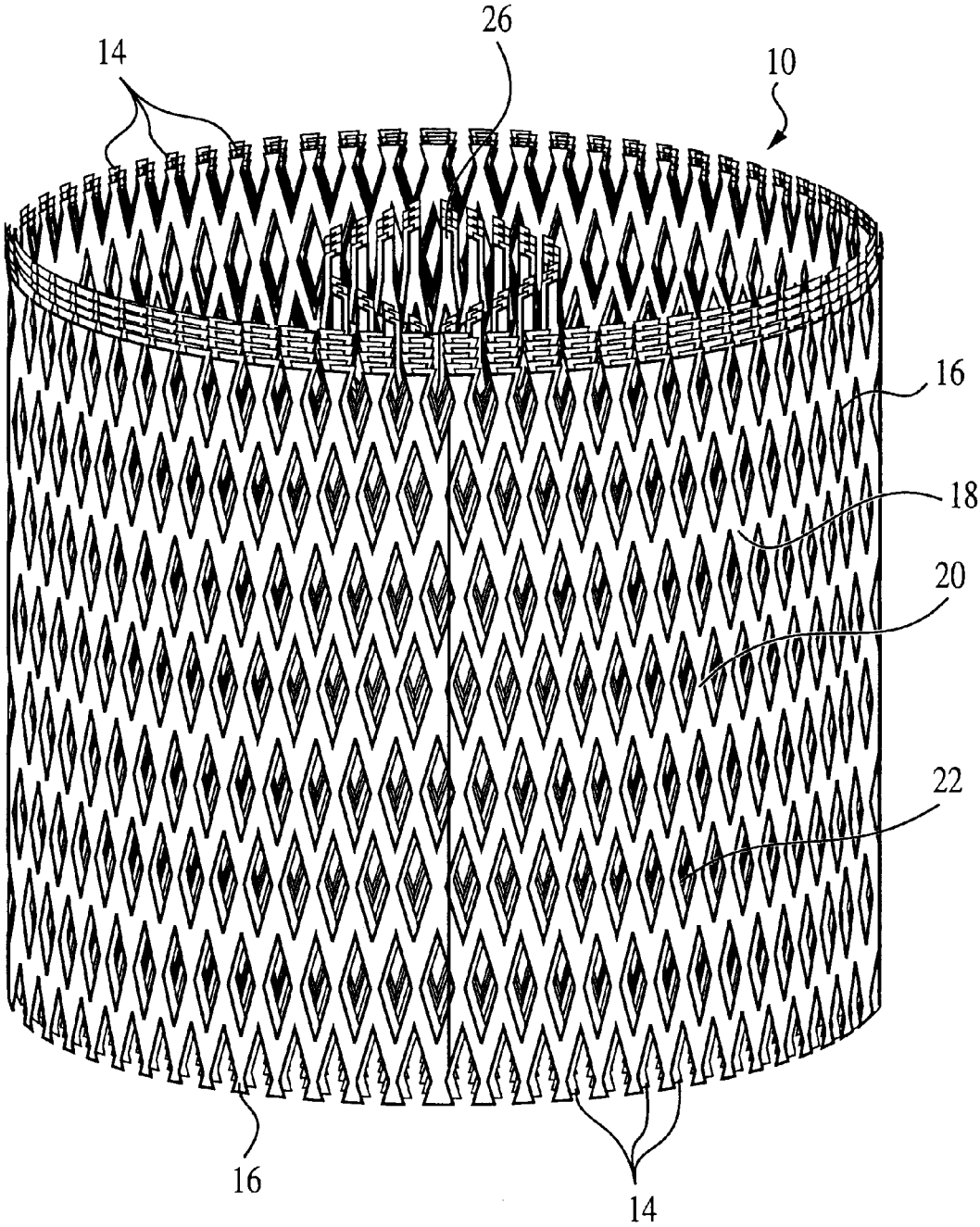
FIG. 2 is a perspective drawing of a first embodiment of the evaporative element of the present invention.

FIG. 2 shows a first embodiment of the evaporative element 10 having a fold, such that the size of the evaporative element is adaptable by varying the evaporative element between a folded and an unfolded configuration. Preferably, it includes a plurality of prefolded, stacked layers of a water retaining media 14 and at least one layer of a prefolded, perforated, substantially rigid, malleable material 16. Both the water retaining media 14 and the perforated, substantially rigid material 16 are preferably made of slit and expanded construction. This construction is known in the art for making evaporative elements for humidifiers, as taught in U.S. Pat. No. 5,374,381, herein incorporated by reference. When the materials are slit and expanded, shown best in FIG. 3, a lattice is formed of bridges 18 and strings 20 defining openings 22 therein. It is desirable to stagger the openings 22 in adjacent layers to expose a greater surface area of the materials to the air flow. Generally, the air flows normally to the layers shown, although in a small scale, the air chooses a tortuous path around the strings 20 and bridges 18 to find openings 22 at each layer. This flow pattern brings the air in contact with more water at the surface of the evaporative element 10. Conventional machinery for slitting and expanding materials are preferably used, resulting in an economical manufacturing process.

The water retaining media 14 may comprise any substance that is air permeable and will hold sufficient water to provide suitable evaporation. Water absorbent materials, such as paper or spongy fabrics are preferred, but non-absorbent materials may be used if sufficient water is held on the surface of the material to provide suitable contact between the air and water.

Multiple layers of thin aluminum foil may be used as the water retaining media 14, if the surface is coated to prevent rapid runoff of the water. Such coatings are well known in the art, for example U. S. Pat. No. 2,955,064, herein incorporated by reference, and are generally based on ceramic or clay compositions. Any coating that provides sufficient water retention properties is suitable for use with this invention. Use of coated foil as the water retaining media 14 produces a longer lasting cartridge 10 because the foil retains its shape longer and is less subject to deterioration than paper media.

Wicking paper is the most preferred water retaining media 14 in this embodiment. The term "wicking paper" is intended herein to mean blotter type papers having superior capillary rise properties. Wicking paper has an exceptional ability to absorb water. It provides a constant supply of water at its surface due to capillary action. As the water evaporates and becomes airborne, the water at the surface of the media 14 is quickly replaced by water being sucked up through the pores of the paper. It also acts to easily distribute water that is distributed to the media 14. If a portion of the paper is immersed in water or in the water path of a trickle down type humidifier, capillary action will also tend to wick away a portion of the water to nearby pores that contain less water. In this embodiment, the resiliency of the paper media 14 tends to expand the media in the unfolded configuration because it tends to decompress itself. This improves the surface area and the ability of the media to hold water compared to the compressed state.

Applicant has discovered that Ahlstrom Filtration grade No. 939-39 paper made by Ahlstrom Filtration, Inc., Mt. Holly Springs, Pa. 17065, is an excellent wicking paper for fabrication of the evaporative element of the invention. The Ahlstrom paper is 97–100% cellulose fiber with a trace of polyamide wet strength resin. The paper has a basis weight of 37–41 lbs. Per ream (20 in.×20 in.×500 sheets). It has a thickness of 0.026 to 0.036 inches. Its wet burst is 150"$H_2O$ min. The Frazier permeability of the Ahlstrom paper is 30–40 cm/ft$^2$. Most importantly, the Ahlstrom grade No. 939-39 paper has a capillary rise ability of 79–112 mm/min. The excellent capillary rise ability of the paper greatly enhances the spreading of water throughout the evaporative element, which improves the evaporative rate.

The preferred malleable, substantially rigid material 16 is a metal. This rigid layer 16 is juxtaposed to at least one of the layers of water retaining media 14 and is suitably rigid to provide structural support to the media layers, and suitably malleable to hold the stacked media layers in either a prefolded or an unfolded configuration. Exact thickness of the rigid material 16 must be determined by the shape and size of the evaporative element 10 that is formed and the number of rigid material layers 16 to be used, but generally, relatively thin materials, such as metal foils, are suitable in this application, and are preferred materials. The thickness of this layer 16 should be no greater than needed to be functional in order to minimize the cost of the evaporative element 10. Thickness of about 0.008 inches is preferable for many applications.

Aluminum foil is the most preferred material 16 because of its light weight, malleability and corrosion resistance. The foil must be perforated in some manner to allow flow of air through the layer. Where slit and expanded construction is used for the substantially rigid material 16, it is preferred that the bridges 18 be oriented horizontally. In this position, there is a natural inclination for the bridge 18 to catch and divert cascading water.

Where the water retaining media 14 is sufficiently rigid to provide its own structural support, the rigid material 16 and the water retaining material 14 are optionally the same substance. This occurs, for example, where coated aluminum foil is used as the water retaining media 14. When this occurs, both functions may be considered to be performed by a single substance. The rigid material layer 16 is also optionally coated to provide additional water retention.

An adhesive means is used for bonding the layers of media together and for bonding the rigid material layer to the water retaining media layers to form a laminated evaporative element. Any adhesive may be used that does not overly hinder the evaporation function by sealing too much of the water retaining surface 14. Hot melt adhesive has been found to be suitable when used to coat only the edges of the adjoining surfaces. Where slit and expanded construction is used, the edges of the bridges 18 and strings 20 are coated, thereby forming a bond with the bridge or string of the adjacent layer.

It is preferable that a single adhesive be used to bond the layers to each other, however, the use of two or more adhesives is contemplated and considered to be within the scope of this invention. The choice of the water retaining media 14 and the rigid material 16 may require that one adhesive be required for bonding the water retaining media layers 14 together, and a different adhesive needed to bond the rigid material 16 to the water retaining media 14.

In this embodiment, adaptation of size is accomplished by means of a fold 26 in the evaporative element 10. The size of the evaporative element 10 is conveniently adaptable by varying the evaporative element between a folded and an unfolded configuration. The evaporative element 10 is made to an unfolded size designed to replace a large cartridge. Preferably during manufacture or packaging, the element 10 is folded to conform to a smaller, different diameter replacement cartridge. The malleability of the substantially rigid material layer 16 serves to hold the evaporative element 10 in the chosen shape, whether it is folded or unfolded. Folding of the element 10 during the manufacturing or packaging stage holds it in the folded configuration helps to set the crease and hold the folded shape. Adapting of the evaporative element from one size to a different size by merely straightening the fold 26 provides an easy and convenient method of varying the size of the replacement to fit more than one humidifier model.

Figure 4:
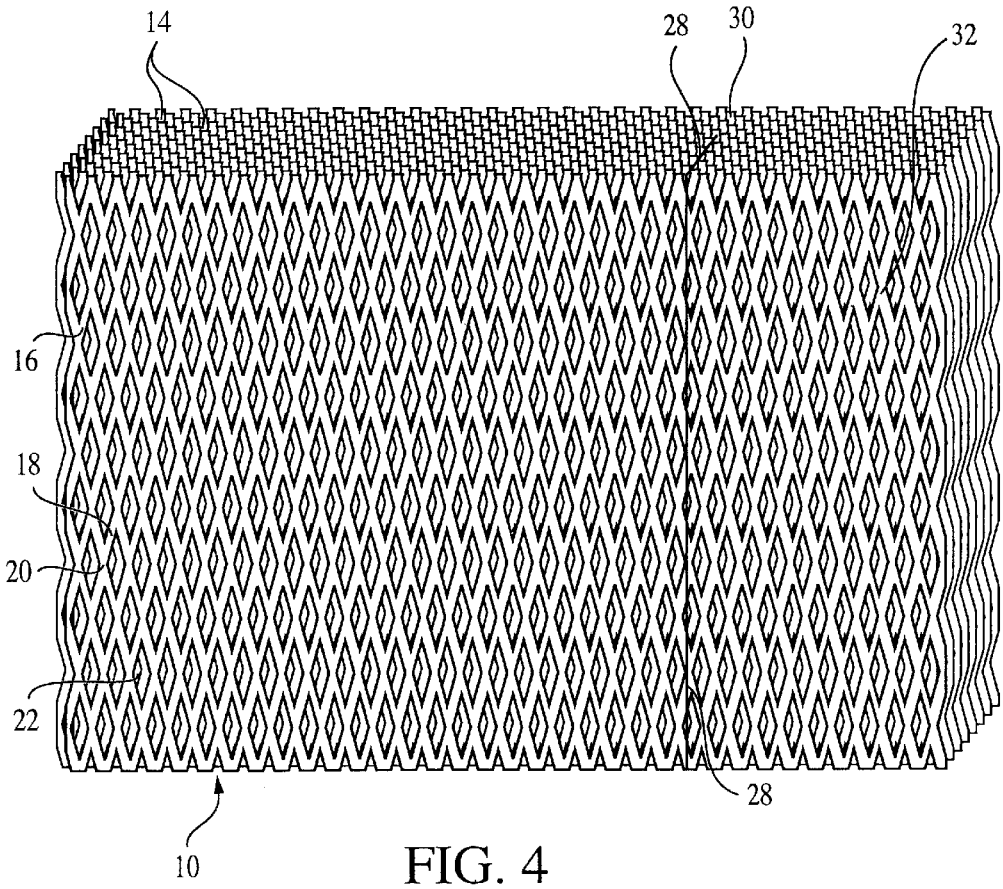
FIG. 4 is a perspective view of an alternative, second embodiment of the evaporative element of the invention.

Referring now to FIG. 4, in a second embodiment, the size of the evaporative element 10 is adapted by means of a slit 28 that extends through a sufficient portion of the evaporative element to form a hinge 30 and a separable segment 32 that is easily detached without the use of tools. The size of the evaporative element 10 is therefore adaptable by bending the element at the hinge 30 and breaking off the separable segment 32 to create an evaporative element of a size smaller than when purchased. Separation of the separable segment 32 from the remaining evaporative element 10 is preferably as easy as applying a force on either side of the hinge 30, tending to widen the slit 28, and having the uncut layers break apart under the strain.

Choice of the water retaining media 14, the rigid material 16 and the optional coating will determine the separability of the components. The preferred materials, including both the water retaining media 14 and the rigid material 16, should be able to snap apart at the slit 28 under force applied by hand. If these materials are too soft, the evaporative element 10 may bend and flex too much to break apart easily. The evaporative element 10 may not bend or break at all of the water retaining media 14 and rigid materials 16 are too strong, and require the use of tools to separate the two portions. The coating that is optionally a part of the water absorbent media 14, may also contribute to the ability of the evaporative element 10 and the separable segment 32 to break away from each other. For this reason, multiple layers of the aluminum foil, slit, expanded, and covered with a water retaining coating, is the most preferred water retaining media 14 for this embodiment.

The materials from which the evaporative element 10 is fabricated also determine the depth of the slit 28. Any depth is suitable as long as the evaporative element holds together in the unadapted form, and the separable portion 32 breaks away when force is applied by hand. Preferably, the slit will extend about ½ to about ¾ of the thickness of the evaporative element.

Figure 5:
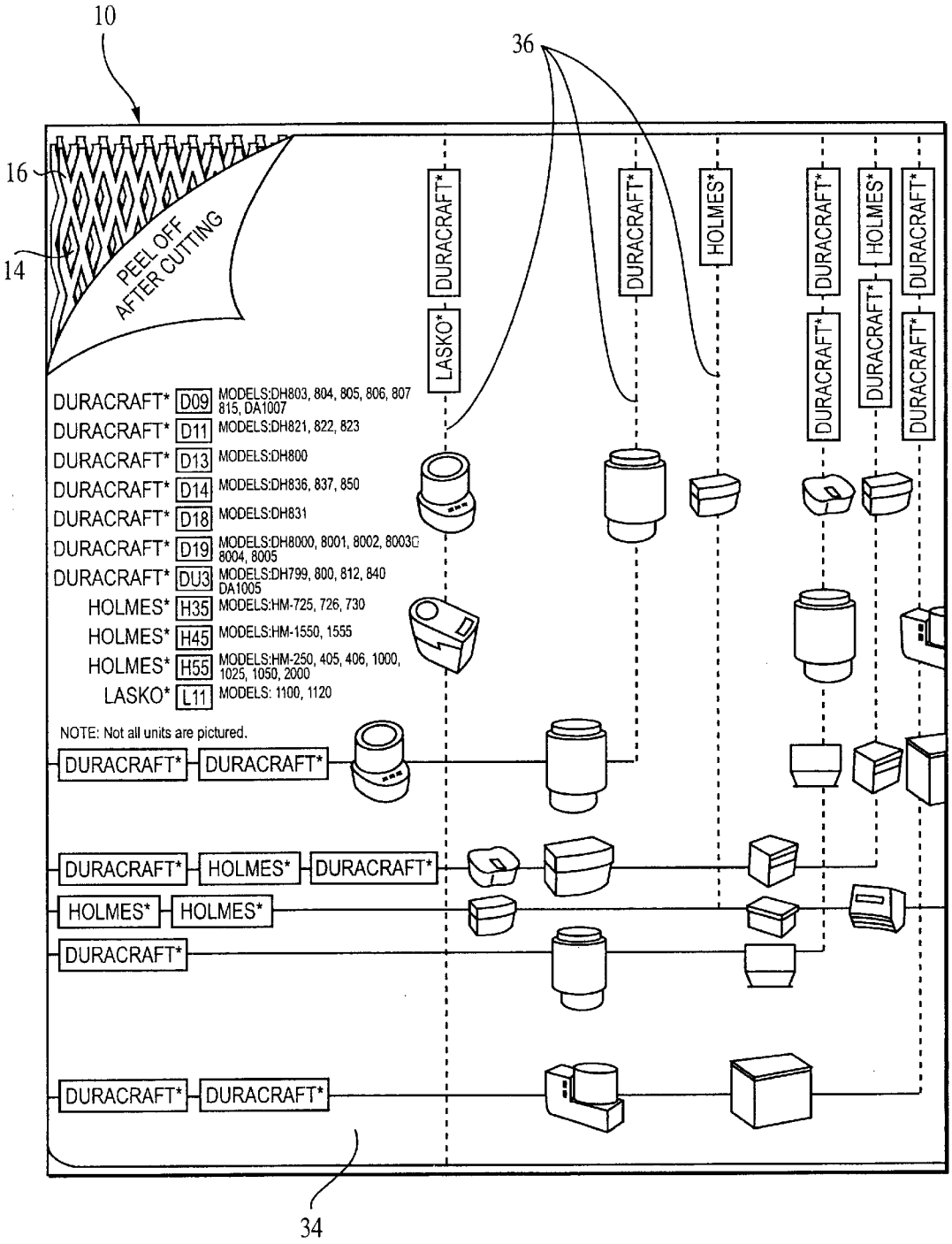
FIG. 5 is a top plan view of a third embodiment of the invention.

A third embodiment of this invention, shown in FIG. 5, includes a guide 34 attached to the evaporative element for cutting it to one of a plurality of cut configurations, such that the size of the evaporative element is adaptable by varying said evaporative element between an uncut and one of said plurality of cut configurations. Preferably, the evaporative element includes a plurality of stacked layers of cuttable, water retaining media 14. The adhesive means bonds the layers together, forming a laminated evaporative element 10. Prior to packaging, the guide 34 is attached to the evaporative element. The consumer obtains one of a plurality of cut configurations by cutting the cutting guide and the evaporative element together to obtain the desired size.

Choice of preferred materials for the water retaining media 14 and the rigid support material 16 must be cuttable, for example, with scissors or a utility knife, in order to be suitable for use in this embodiment. Wicking paper is the most preferred water retaining media 14, and aluminum foil remains the preferred material for use as the rigid support material 16 as they are easily cut to size. The preferred evaporative element 10 is constructed as described in the first embodiment.

The guide 34 must be made of a suitable material and attached to the evaporative element in a manner such that the evaporative element 10 is cut with the guide remaining in place. Since the guide 34 will generally not be made of materials suitable for use as part of the evaporative element 10, the method of attaching the guide 34 should also be consistent with easy removal of the guide after cutting, but just prior to installation of the evaporative element 10 in the humidifier A. Preferably, an adhesive is used to attach the guide 34 to the evaporative element 10 with sufficient strength that it does not move during cutting, but that easily peals off after cutting is complete.

Most preferably, the guide 34 is a preprinted paper that is attached to the evaporative element 10 prior to packaging, so that, when received by the consumer, no action is required by the consumer in attaching the guide to the evaporative element. The guide includes cutting lines 36 that clearly direct the consumer how to trim the evaporative element to obtain the correct size required. Use of color-coded lines, pictures or icons 38 are optionally used to help the consumer choose and stay on the appropriate set of cutting lines 36.

Figure 6:
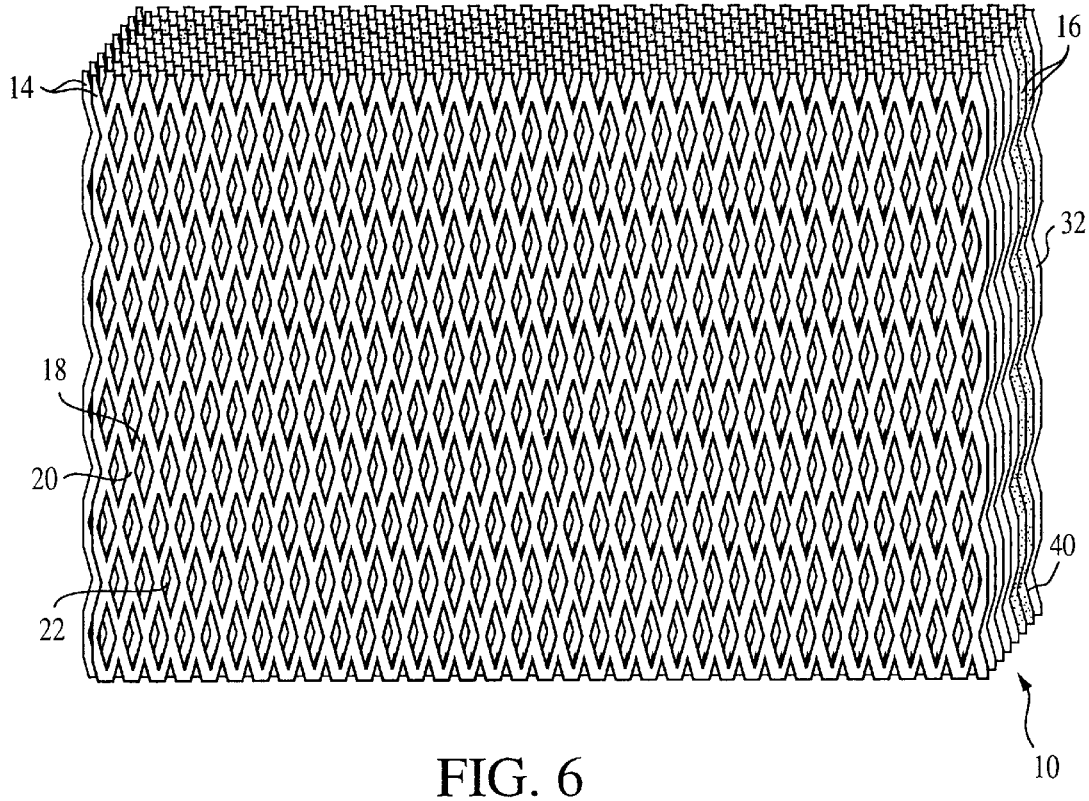
FIG. 6 is a perspective view of a fourth embodiment of the invention.

FIG. 6 shows a fourth embodiment of this invention, whereby the evaporative element 10 is adaptable between layers rather than across layers, as demonstrated by the other embodiments, allowing the user to modify the thickness of the evaporative element where necessary to fit multiple humidifiers A. As in the previous embodiments, the evaporative element 10 includes a plurality of stacked layers of water retaining media, preferably wicking paper as described above.

The evaporative element also includes at least two layers of a perforated, substantially rigid material 16 that are juxtaposed to each other. When adapting this evaporative element 10, each of the two adjacent layers is grasped and they are pulled apart, separating the evaporative element between the layers of rigid material 16. Use of two or more rigid layers 16 provides strength to withstand the separation, as well as ensuring that there is a support layer on the evaporative element 10 after being adapted. Preferably, the rigid material 16 is metal, plastic, stiff paper or cardboard, but can be any material that provides support to the water retaining media 14 and is strong enough to hold together during the process of pulling apart the layers during adaptation. Plastic is the most preferred material for the rigid layers 16.

At least one of the layers of rigid material is juxtaposed to a plurality of stacked layers of the water retaining media 14. Preferably there are several layers of water retaining media 14 adjacent to each side of the two or more layers of rigid material 16, sandwiching the rigid material between two stacks of the media. The position of the rigid material layers within the evaporative element will determine the thickness of the pieces obtained when the evaporative element is adapted. Both the water retaining media 14 and the perforated, substantially rigid material 16 are preferably made of slit and expanded construction.

In this embodiment, two adhesives are used to allow the layers to separate between the rigid material layers 16, but maintain strength between other layers. A first adhesive bonds the layers of water retaining media 14 to each other and to the adjacent layer of substantially rigid material 16. Suitable adhesives include any of the adhesives disclosed in the other embodiments above. A second adhesive, weaker than the first adhesive, is applied between two of the rigid material layers 16 forming a separable element 32. A suitable second adhesive bond is strong enough to hold the evaporative element 10 together before separation, but separates without the use of tools when the rigid layers 16 are pulled apart. Preferred second adhesives include those that bond only to the surfaces between the rigid layers 16, such as adhesive webs. When the evaporative element 10 is grasped to separate the layers, the bonds of the second adhesive will break first since it is weaker than the first adhesive. Thus, the thickness of the separable element 32 is controlled by the position of the rigid layers 16 and the consistent separation of the element at the bond between the rigid layers.

EXAMPLE 1

A circular evaporative element was made according to the first embodiment of the invention.

Unfolded diameter: 12½ inches

Folded diameter: 10¾ inches

Height: 7¾ inches

Construction: 11 layers of wicking paper with 1 layer of aluminum around the outside of the evaporative element; paper and metal slit and expanded construction: slits ⅝ inches long at ¼ inch spacing; bridge ⅛ inch; string ¼ inch; openings 9/16×¼ inches.

EXAMPLE 2

A rectangular evaporative element was made according to the second embodiment of the invention.

Large size evaporative element: 13 inches×10 inches

Separable portion: 2¾ inches×10 inches

Small size evaporative element: 10 inches×10 inches

Overall depth: 1⅜ inches

Slit Depth: 1 inch

Construction: Metal slit and expanded construction; 11 layers of coated aluminum foil; slits ⅝ inches long at ¼ inch spacing; bridge ⅛ inch; string ¼ inch; openings 9/16×¼ inches.

EXAMPLE 3

An evaporative element was made according to the third embodiment of this invention. The construction of the evaporative element was the same as that used in Example 1.

A guide, as shown in FIG. 5, was attached with a small amount of hot melt adhesive. Cutting lines were color coded as well as marked with small pictures of the units that would use an evaporative element of the size produced by the cutting lines.

Uncut size: 9 inches×9¼ inches

Cut sizes (inches): 8½×8¾; 8 1/16×6 7/16; 7⅝×7½; 6½×6¾; 5¾×5¾; 3⅞×5¾; 3⅞×9¼; 9×7¼.

It is also contemplated that this invention could be used to make an evaporative element that would adapt to fit more than two sizes by applying the principle multiple times, as demonstrated in Example 3. For example, an evaporative element 10 of the first embodiment is foreseen that is designed to fit multiple humidifier models by application of multiple folds 26. Multiple slits 28 are optionally used in the second embodiment, however, care must be taken that the slits are not too close together. If a separable portion 32 is made too small, application of force could result in breakage along a slit 28 that was not intended, or, it may break along portions of two slits 28 and across a separable portion 32. Multiple slits 28 should be used only where there is sufficient space between the slits that a force applied to one slit will not cause rupture along an unintended slit. As shown in FIG. 5, the cutting guide 34 of the third embodiment readily lends itself to adaptation of the evaporative element 10 to multiple sizes. The cutting guide 34 could easily be combined with separable layers to create an evaporative element 10 that is adaptable in all three dimensions.

While particular embodiments of the adaptable evaporative element for a humidifier have been shown and described, it will be appreciated by those skilled in the art that changes and modifications may be made thereto without departing from the invention in its broader aspects and as set forth in the following claims.

What is claimed is:

1. An adaptable evaporative element for a humidifier, comprising a circular evaporative element at least one fold, such that the diameter size of said evaporative element is adaptable by at least partially folding or unfolding said at least one fold.

2. An adaptable evaporative element for a humidifier comprising:

a plurality of stacked layers of a water retaining media;

at least one layer of a perforated, substantially rigid, malleable material juxtaposed to at least one of said layers of water retaining media for supporting said layers, and for holding said stacked layers in either a prefolded or an unfolded configuration;

an adhesive for bonding said layers of water retaining media together and for bonding said rigid material layer to said media layers, forming a laminated evaporative element into a circular shape; and at least one fold in said evaporative element such that the diameter of said evaporative element is adaptable by varying said evaporative element between a folded and an at least partially unfolded configuration.

3. The adaptable evaporative element of claim 2, wherein said water retaining media comprises a water absorptive media.

4. The adaptable evaporative element of claim 3, wherein said water absorptive media comprises wicking paper.

5. The adaptable evaporative element of claim 2, wherein said water retaining media comprises a slit and expanded media.

6. The adaptable evaporative element of claim 2, wherein said water retaining media further comprises a water absorptive coating.

7. The adaptable evaporative element of claim 2 wherein said substantially rigid, malleable material comprises metal.

8. The adaptable evaporative element of claim 7, wherein said metal comprises aluminum.

9. The adaptable evaporative element of claim 2, wherein said substantially rigid, malleable material is made of slit and expanded construction.

10. The adaptable evaporative element of claim 2, wherein said fold is in the shape of an S-shaped fold.

11. A circular evaporative element for use in a plurality of humidifiers, comprising:

a plurality of stacked layers of a water retaining media;

at least one layer of a perforated, substantially rigid, malleable material juxtaposed to at least one of said layers of water retaining media for supporting said layers;

a means for adapting said circular evaporative element among a plurality of sizes to fit the plurality of humidifiers, said means for adapting, comprising at least one fold; and an adhesive means for bonding said layers of water retaining media together and for bonding said rigid material layer to said media layers, forming a laminated evaporative element.

12. An evaporative element adaptable between a small size for use in a first humidifier and a large size for use in a second humidifier, comprising an evaporative element having a plurality of folds, such that the size of said evaporative element is adaptable to said small size wherein one or more of said folds are in an at least partially folded position and to said large size wherein one or more of said folds are at least partly unfolded relative to said small size.

* * * * *